US006000816A

United States Patent [19]

Serizawa et al.

[11] Patent Number: 6,000,816

[45] Date of Patent: Dec. 14, 1999

[54] VEHICLE HEAD LAMP

[75] Inventors: Hiroyuki Serizawa; Naoki Uchida, both of Shizuoka, Japan

[73] Assignee: Koito Manufacturing Co., Ltd., Tokyo, Japan

[21] Appl. No.: 08/904,183

[22] Filed: Aug. 1, 1997

[30] Foreign Application Priority Data

Aug. 2, 1996 [JP] Japan ..... 8-220485

[51] Int. Cl.[6] ..... F21V 7/00

[52] U.S. Cl. ..... 362/297; 362/507; 362/518; 362/346

[58] Field of Search ..... 362/518, 517, 362/516, 346, 297, 507

[56] References Cited

U.S. PATENT DOCUMENTS

| | | | |
|---|---|---|---|
| 4,704,661 | 11/1987 | Kosmatka | 362/518 |
| 5,171,082 | 12/1992 | Watanabe | 362/518 |
| 5,406,464 | 4/1995 | Saito | 362/518 |
| 5,416,671 | 5/1995 | Uchida | 362/518 |
| 5,695,276 | 12/1997 | Tatsukawa | 362/297 |

FOREIGN PATENT DOCUMENTS

| | | |
|---|---|---|
| 0 678 703 | 10/1995 | European Pat. Off. . |
| 0678703A | 10/1995 | European Pat. Off. . |
| 2 704 044 | 10/1994 | France . |
| 2704044A | 10/1994 | France . |
| 622 156 | 10/1935 | Germany . |
| 622156C | 10/1935 | Germany . |

*Primary Examiner*—Sandra O'Shea
*Assistant Examiner*—Todd Reed Hopper
*Attorney, Agent, or Firm*—Sughrue, Mion, Zinn, Macpeak & Seas, PLLC

[57] ABSTRACT

A head lamp in which the sub-lamp luminous intensity distribution pattern is designed to control light from a discharge bulb by a plurality of reflective surface elements constituting the reflective surface of a reflector even in such a state that the reflector has been subjected to aiming adjustment. A reflective surface element (**22A*s*1) which is positioned in the outermost side portion out of a plurality of reflective surface elements (22A*s*) constituting the horizontal cut-line forming area (22A) of a reflector reflective surface (22) has a concave horizontal sectional shape and rays of the light reflected from the reflective surface element (22A*s*1) are made to horizontally cross each other so as to form a luminous intensity distribution pattern (PA1). Thus, the reflector is aimed to the left and with the luminous intensity distribution pattern (PA1) as a leftover luminous intensity distribution pattern on a oblique cut line side with respect to the original luminous intensity distribution pattern when the light reflected from the left-hand end portion of the reflective surface element (22A*s*1) is shaded by an extension (28**), part of the hot zone (HZ) of a sublamp luminous intensity distribution pattern (P) is formed therewith.

20 Claims, 7 Drawing Sheets

VEHICLE HEAD LAMP

BACKGROUND OF THE INVENTION

1. Field of the Invention

The present invention relates to a vehicle head lamp having a discharge bulb and more particularly to a head lamp for forming a sub-lamp luminous intensity distribution pattern.

2. Background

Since discharge bulbs are capable of high luminance irradiation, they have increasingly been adopted as light sources for vehicle head lamps in recent years.

In a head lamp equipped with such a discharge bulb, a sub-lamp luminous intensity distribution pattern, which is excellent in remote visual recognizability and has a wide is angle of irradiation, is obtainable when the sub-lamp luminous intensity distribution pattern has an oblique and a horizontal cut line.

There has been proposed a head lamp which is constructed so that a reflector having a reflective surface constituting of a plurality of reflective surface elements is used for forming such a sub-lamp luminous intensity distribution pattern, and the light reflected from the discharge bulb is controlled by each of the reflective surface elements.

FIG. 6(*c*) is a horizontal sectional view of three reflective surface elements 22A*s*1', 22A*s*2', 22A*s*3' out of a plurality of reflective surface elements constituting a horizontal cut-line forming area 22A on the reflective surface of a reflector 16 having the aforementioned luminous intensity distribution control function; and FIG. 6(*a*) is a diagram illustrating a screen luminous intensity distribution patterns PA1', PA2', PA3' formed by the respective reflective surface elements 22A*s*1', 22A*s*2', 22A*s*3'.

As shown in FIG. 6(*b*), the luminous intensity distribution patterns PA1', PA2', PA3' are those formed along a horizontal cut line CL2 and the left-hand end portions of the patterns are formed so as to extend up to the lower position of an oblique cut line CL1, whereby part of the hot zone (what is irradiated the brightest) HZ of the sub-lamp luminous intensity distribution pattern P for leftward luminous intensity distribution is formed.

The problems associated with this arrangement are as follows. As shown in FIG. 6(*c*), each of the reflective surface elements 22A*s*1', 22A*s*2', 22A*s*3', . . . constituting the horizontal cut-line forming area 22A has a convex horizontal sectional shape. This is because the luminous intensity distribution design becomes relatively easy to make and the convex reflective surface is slightly more attractive than a concave reflective surface when the reflective surface is formed into the convex shape as the light reflected from each of the convex reflective surface elements is irradiated from the left-hand end portion to the left and also irradiated from the right-hand end portion to the right.

However, the following problems are posed when horizontal sectional shapes of the reflective surface elements 22A*s*1', 22A*s*2', 22A*s*3', . . . are evenly made convex.

In a case where an extension 28 and the like are provided along the outer peripheral edge of the reflector 16 in front of the reflector 16 as shown in FIG. 6(*c*), for example, the light reflected from the left-hand end portion of the reflective surface element 22A*s*1' positioned in the outermost side portion of the horizontal cut-line forming area 22A is shaded by the extension 28 and the like and is, therefore, not irradiated in the forward direction of the light fixture. Consequently, the luminous intensity distribution pattern PA1' formed-by the light reflected from the reflective surface element 22A*s*1' becomes the pattern shown by the solid line with the slight wane of its left-hand end portion.

When the reflector 16 is aimed to the left, moreover, the light reflected from the left-hand end portion of the reflective surface element 22A*s*1' is more shaded by the extension 28 and the like as shown in FIG. 6(*c*) and the luminous intensity distribution pattern PA1' formed by the light reflected from the reflective surface element 22A*s*1' becomes a luminous intensity distribution pattern with the absence of the left half portion, as shown in FIG. 6(*b*). Thus, this luminous intensity distribution pattern PA1' contributes nothing to the formation of the hot zone HZ of the sub-lamp luminous intensity distribution pattern P. Further, the pattern PA1' results in the formation of a relative dark portion between the luminous intensity distribution pattern PA1' and the hot zone. Therefore, there arises a problem in that the sub-lamp luminous intensity distribution pattern P becomes a luminous intensity distribution pattern which makes it hard to visually recognize the remote forward field of the vehicle.

There have existed the foregoing problems in conventional head lamps using a halogen bulb, for example, as a light source but they still remain relatively minor. However, when a discharge bulb is employed as a light source, the aforementioned problems tend to become conspicuous because the discharge bulb forms an image entirely different in luminous intensity distribution characteristics from the halogen bulb.

More specifically, FIGS. 7(*a*) and (*b*) are diagrams illustrating luminous intensity distribution in the longitudinal direction of an image at a light source when light from the light source is reflected from one point of a reflector reflective surface 22 and emitted onto a front screen. As shown in FIG. 7(*a*), the luminous intensity distribution in the longitudinal direction of an image I' at the light source exhibits such characteristics that the luminous intensity gradually lowers in both its side portions when the light source is (the filament 18*a*' of) a halogen bulb. On the other hand, when the light source is (the light emitting portion (arc) 18*a* of) a discharge bulb, the luminous intensity distribution in the longitudinal direction of an image I at the light source exhibits such characteristics that the luminous intensity sharply drops at both its side portions as shown in FIG. 7(*b*).

When the image I having the luminous intensity distribution characteristics causing the luminous intensity in both end portions in the longitudinal direction to sharply drop is deflected or diffused along the horizontal cut line CL2 shown in FIG. 6(*a*), each of the luminous intensity distribution patterns PA1', PA2', . . . thus formed becomes a luminous intensity distribution pattern of high luminous intensity up to both end portions. In cooperation with extremely high power of the discharge bulb itself, both horizontal end portions of each of the luminous intensity distribution patterns PA1', PA2', . . . becomes very bright.

For the reason above, the dark portion formed between the luminous intensity distribution pattern PA1' and the hot zone HZ in FIG. 6(*b*) noticeably appears in comparison with the prior art head lamp using a halogen bulb or the like as a light source.

An object of the present invention made in view of the situation above is to provide a vehicle head lamp for forming a sub-lamp luminous intensity distribution pattern which is arranged so as to control light from a discharge bulb by a plurality of reflective surface elements constituting a reflector reflective surface, the head lamp making obtainable a desired sub-lamp luminous intensity distribution pattern while the reflector is being subjected to aiming adjustment.

In order to accomplish the above object of the present invention, a novel arrangement has been made for the arrangement of a reflective surface element which is positioned in the outermost side portion of a horizontal cut-line forming area.

According to the present invention, a vehicle head lamp comprising a discharge bulb and a reflector having a reflective surface constituting of a plurality of reflective surface elements for reflecting light from the discharge bulb forward so as to form a sub-lamp luminous intensity distribution pattern having an oblique and a horizontal cut line by controlling the light reflected from each of the reflective surface elements, is characterized in that (1) the reflective surface element positioned in the outermost side portion out of the plurality of reflective surface elements constituting a horizontal cut-line forming area on the reflective surface has a concave horizontal sectional shape and that (2) the reflective surface element adjacent to the inside of the reflective surface element in the outermost side portion has a convex horizontal sectional shape.

On condition that the reflective surface element "adjacent to the inside of the reflective surface element" in the outermost side portion has a convex horizontal sectional shape, it is not always necessary for (another or a plurality of other) reflective surface elements, which are positioned further inward and constitute the horizontal cut-line forming area, to have the convex horizontal sectional shape.

Since the reflective surface element positioned in the outermost side portion out of the plurality of reflective surface elements constituting the horizontal cut-line forming area of the reflector reflective surface has the concave horizontal sectional shape according to the present invention, rays of light incident on the reflective surface element from the discharge bulb are reflected forward in such a way as to cross each other.

Consequently, even though the light reflected from the outer end portion of the reflective surface element positioned in the outermost side portion is shaded by the extension and the like when the reflector is aimed outward, the luminous intensity distribution pattern formed by the reflected light emitted from the other portion of the reflective surface element in the forward direction of the lighting fixture without being shaded by the extension and the like becomes a luminous intensity distribution pattern with the leftover portion on the oblique cut-line side with respect to the original luminous intensity distribution pattern, so that this luminous intensity distribution pattern forms part of the hot zone of the sub-lamp luminous intensity distribution pattern and prevents a dark portion from being formed between the luminous intensity distribution pattern and the hot zone. Therefore, there is no possibility of allowing the formation of the sub-lamp luminous intensity distribution pattern which makes it hard to visually recognize the remote forward field of the vehicle even at the time of aiming.

Thus, in the head lamp for forming the sub-lamp luminous intensity distribution pattern so arranged as to control light from the discharge bulb by the plurality of reflective surface elements constituting the reflector reflective surface according to the present invention applied for patent, a desired sub-lamp luminous intensity distribution pattern is obtainable even in such a state that the reflector has been subjected to aiming adjustment.

With the arrangement above, the reflective surface element positioned in the outermost side portion and the reflective surface element (the second reflective surface element) adjacent to the inside of the reflective surface element in the outermost side portion are set to have substantially the same horizontal diffusion angle of reflection, whereby luminous intensity distribution control is made possible in that the second reflective surface element is used to form a luminous intensity distribution pattern to be formed originally by the reflective surface element positioned in the outermost side portion and with respect to the luminous intensity distribution pattern formed by the reflective surface element in the outermost side portion, it is utilized additionally for the hot-zone reinforcing purpose. Thus, a stable sub-lamp luminous intensity distribution pattern is formable, irrespective of the aiming position.

Incidentally, with respect to the reflective surface element positioned in the outermost side portion out of the plurality of reflective surface elements constituting the oblique cut-line forming area on the reflective surface, the luminous intensity distribution pattern formed by the light reflected from the reflective surface element generally forms part of the hot zone of the sub-lamp luminous intensity distribution pattern. Even though the light reflected from the outer end portion is shaded by the extension and the like at the time of outward aiming of the reflector because the reflective surface element is allowed to have the convex horizontal sectional shape, no dark portion may be formed between the hot zone and the luminous intensity distribution pattern formed by the reflected light emitted from the other portion of the reflective surface element in the forward direction of the lighting fixture without being shaded by the extension and the like. However, according to the present invention, the concave horizontal sectional shape of the reflective surface element causes the portion on the horizontal cut line side to be left as a luminous intensity distribution pattern with respect to the original luminous intensity distribution pattern at the time of outward aiming of the reflector to ensure that a sub-lamp luminous intensity distribution pattern for making it easy to visually recognize the remote forward field of the vehicle is secured even at the time of aiming.

When the reflector is aimed outward, a body side wall portion, a rim and any other members other than the extension may be considered as an object which shades the light reflected from the outer end portion of the reflective surface element positioned in the outermost side portion of the horizontal or oblique cut-line forming area. However, the extension is often provided along the outer peripheral edge of the reflector and even in this case, the reflected light tends to be shaded at the time of outward aiming. Therefore, according to the present invention, the constitution of the present invention is particularly effective when such an extension is provided in front of and along the outer peripheral edge of the reflector.

Figure 6A:
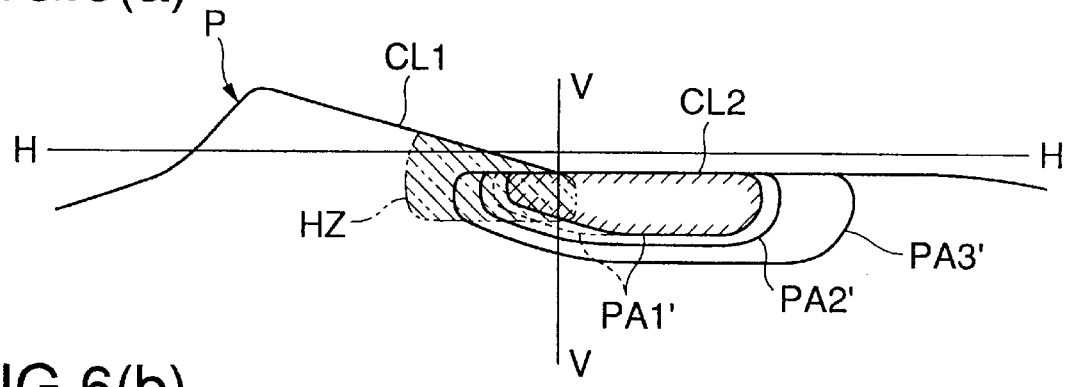
Figure 6B:
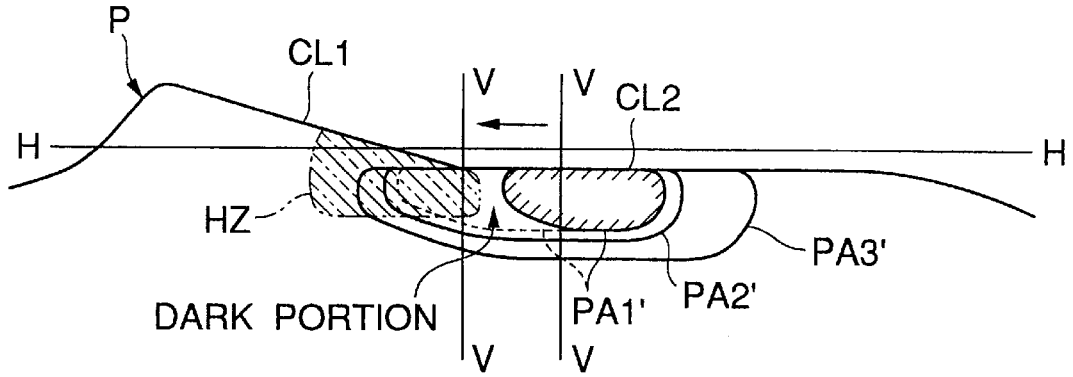
Figure 6C:
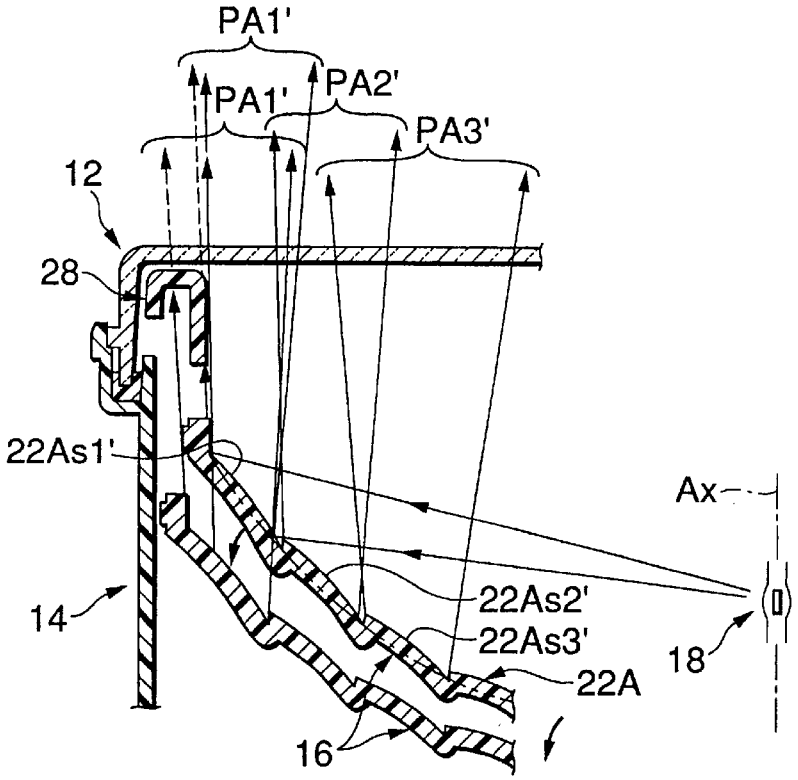
Figure 7A:
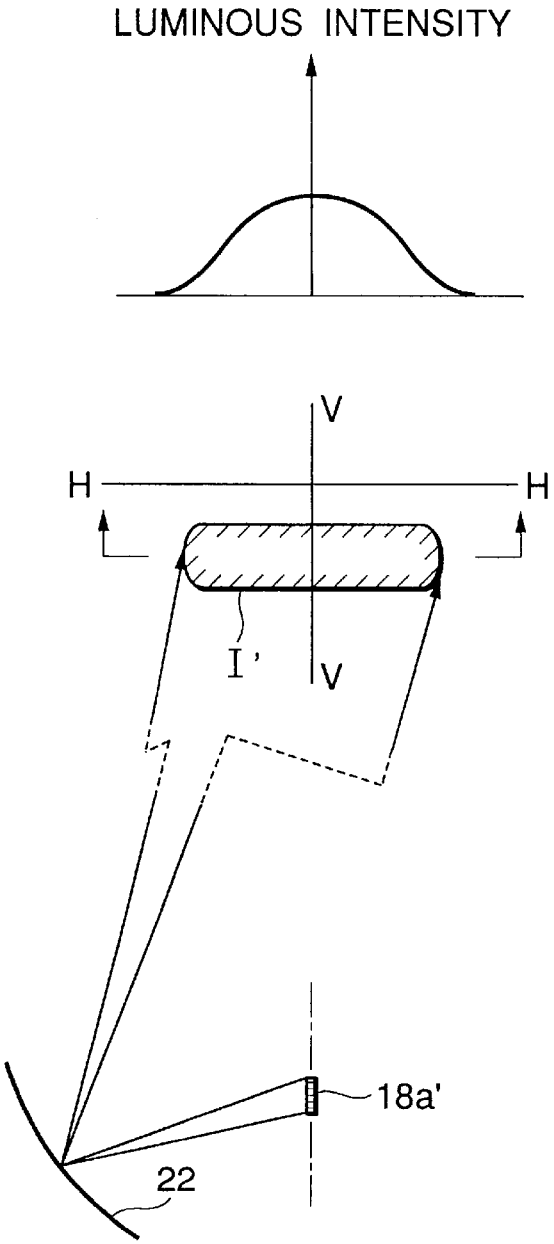
Figure 7B:
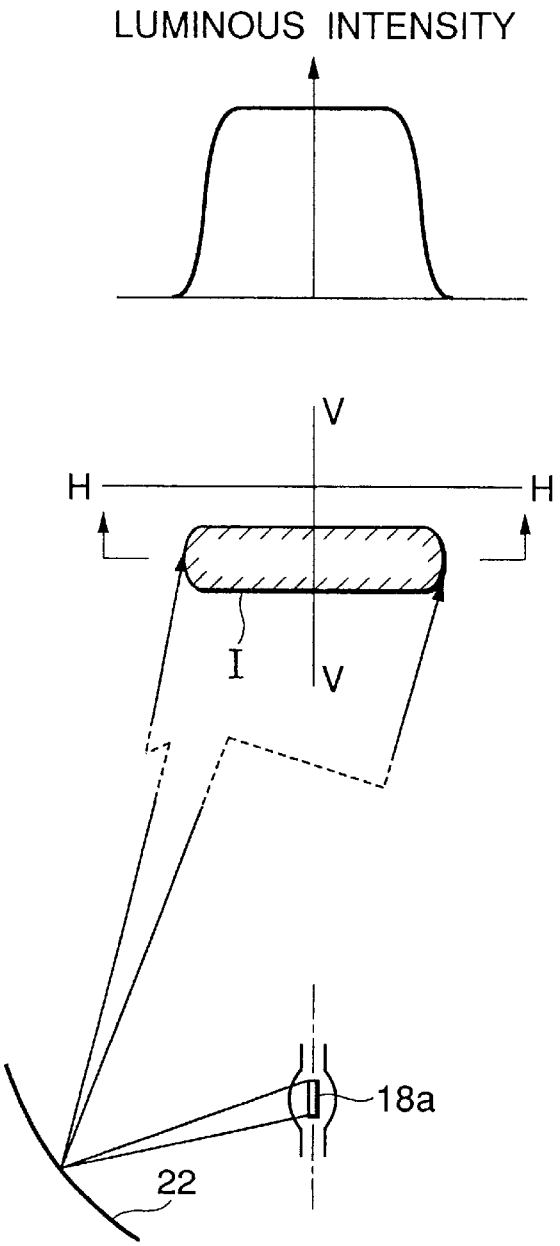

and (*b*) illustrating screen luminous intensity distribution patterns formed by the principal part;

FIGS. 6(*a*)–6(*c*) are diagrams illustrating a conventional head lamp including screen luminous intensity distribution patterns; and FIGS. 7(*a*) and 7(*b*) are diagrams illustrating the difference in luminous intensity distribution characteristics in the longitudinal direction of reflected light image between cases where a halogen and a discharge bulb are used as light sources.

DETAILED DESCRIPTION OF PREFERRED EMBODIMENTS OF THE INVENTION

Figure 1:
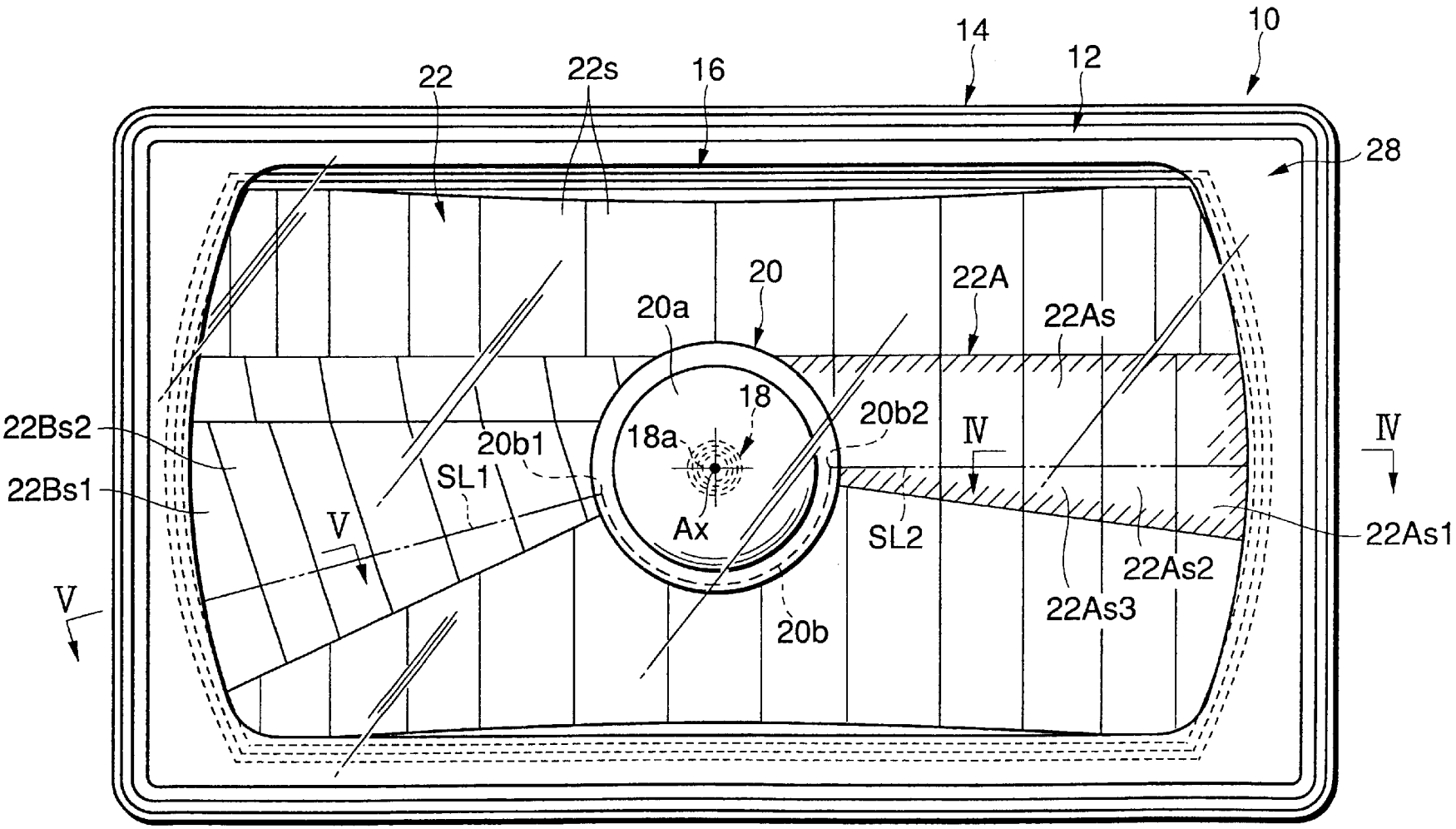
FIG. 1 is an elevational view of a vehicle head lamp embodying the present invention.
Figure 2:
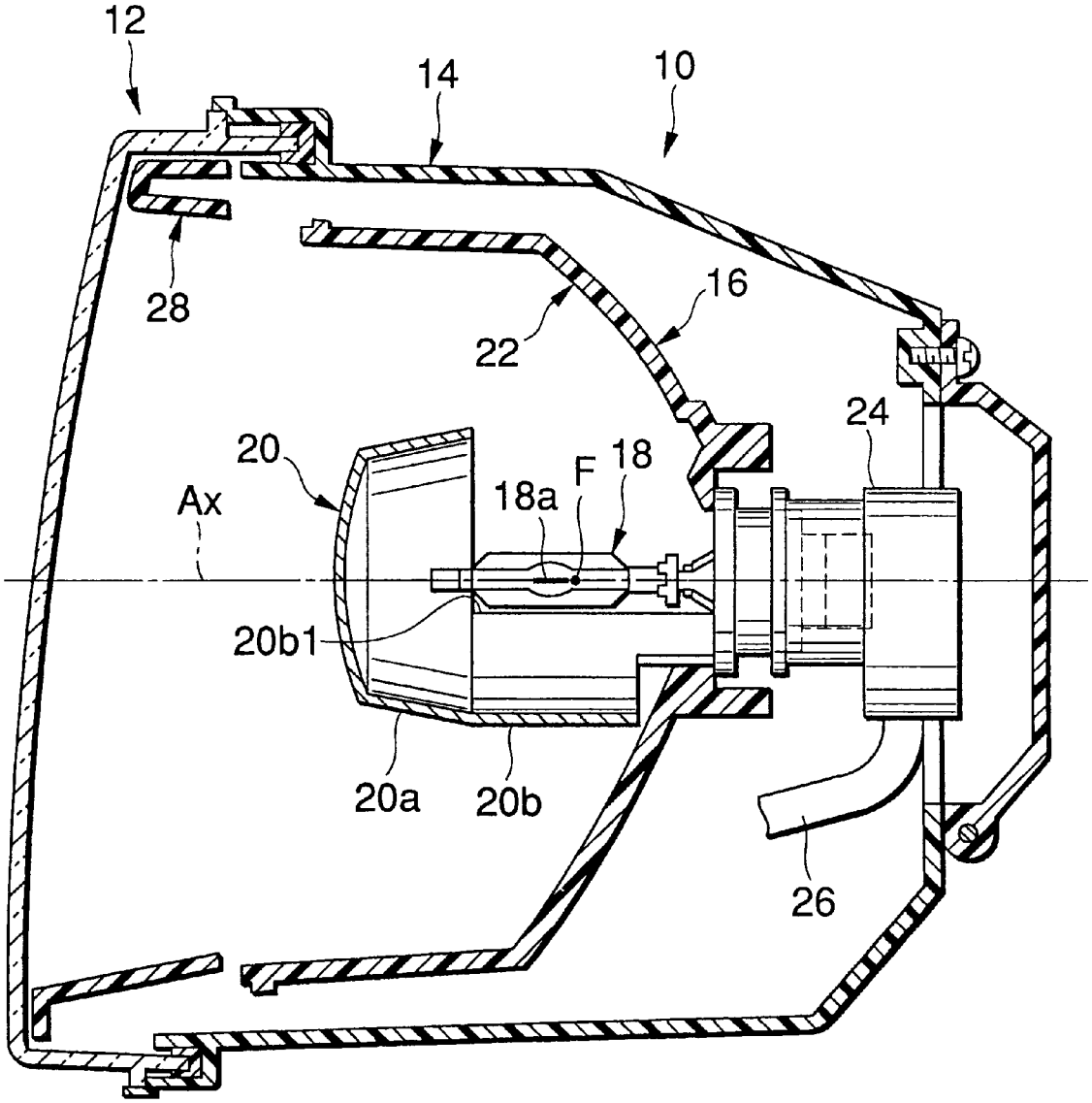
FIG. 2 is a sectional side view of the vehicle head lamp.

An embodiment of the present invention will now be described with reference to the accompanying drawings. FIG. 1 is an elevational view of a vehicle head lamp embodying the present invention; and FIG. 2 a sectional side view thereof.

Figure 3:
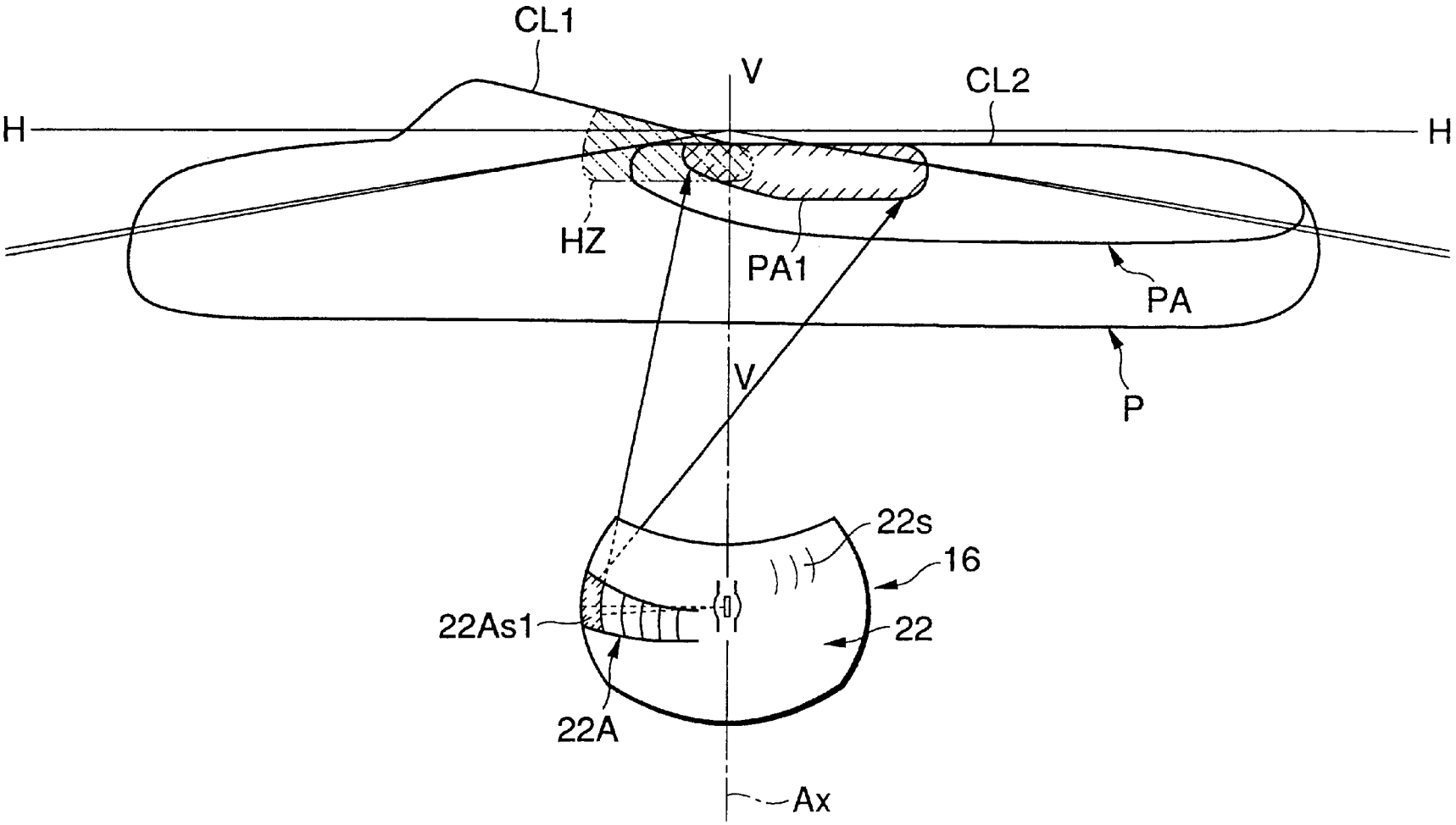
FIG. 3 is a screen luminous intensity distribution pattern showing the function of the present invention.

As shown in these drawings, a head lamp 10 according to this embodiment of the invention is formed with a lens 12, a body 14 and a reflector 16 which is fitted with a discharge bulb 18 and a shade 20, and installed tiltably in both vertical and horizontal directions in a space formed between the lens 12 and the body 14. The head lamp 10 is so arranged as to form a sub-lamp luminous intensity distribution pattern P for leftward luminous intensity distribution having an oblique cut line (a 15° cut line) CL1 and a horizontal cut line CL2 as shown in FIG. 3.

The lens 12 is a transparent lens and the sub-lamp luminous intensity distribution pattern P is formed by the reflector 16.

More specifically, the reflective surface 22 of the reflector 16 is such that a paraboloid of revolution with an optical axis Ax extending longitudinally as a central axis is set as a reference surface, which is divided into segments, and reflective surface elements 22*s* different in curvature from the reference surface are allocated to the respective segments. In other words, the sub-lamp luminous intensity distribution pattern P is obtained by setting the curvature of each reflective surface element 22*s* to a proper value.

The discharge bulb 18 is a metal halide discharge bulb which is mounted on the reflector 16 in the following way. Its optical axis (reference axis) is set in agreement with the optical axis Ax of the reflector 16 and its light emitting portion (arc) 18*a* is positioned slightly ahead of the focal position F of the paraboloid of revolution as the reference surface of the reflector 16. As a high voltage is needed to light the discharge bulb 18, the discharge bulb 18 is connected to a lighting circuit (not shown) via a bulb socket 24 and a high-tension cable 26. Moreover, an extension 28 is provided in front of the reflector 16.

The shade 20 is formed with a cap-like leading end portion 20*a* covering the forepart of the discharge bulb 18 and a semi-cylindrical portion 20*b* which extends rearward from the leading end portion 20*a* in such a way as to cover the lower side of the discharge bulb 18 semi-cylindrically and is secured to the rear end portion of the reflector 16. The direct rays of light directed from the discharge bulb 18 to the forward direction of the lighting fixture are shaded by the leading end portion 20*a*, whereas the light directed from the discharge bulb 18 toward the lower area of the reflective surface 22 of the reflector 16 is shaded by the semi-cylindrical portion 20*b*. Further, the oblique cut line CL1 is formed by the right-hand upper end edge 20*b*1 of the semi-cylindrical portion 20*b* (to the right of the forward direction of the lighting fixture, the same applies to all cases that follow), whereas the horizontal cut line CL2 is formed by the left-hand upper end edge 20*b*2 thereof.

As shown by the chain double-dashed lines of FIG. 1, shadow lines SL1, SL2 of light from the light emitting portion 18*a* of the discharge bulb 18 are formed on the reflective surface 22 of the reflector 16 by the right-hand upper end edge 20*b*1 and the left-hand upper end edge 20*b*2.

Six reflective surface elements 22A*s* constituting a reflective surface area (a horizontal cut-line forming area) 22A shown by slanting lines of FIG. 1 employ the light reflected from the reflective surface elements 22A*s* for forming a luminous intensity distribution pattern PA having the horizontal cut line CL2 as shown in FIG. 3.

Figure 4A:
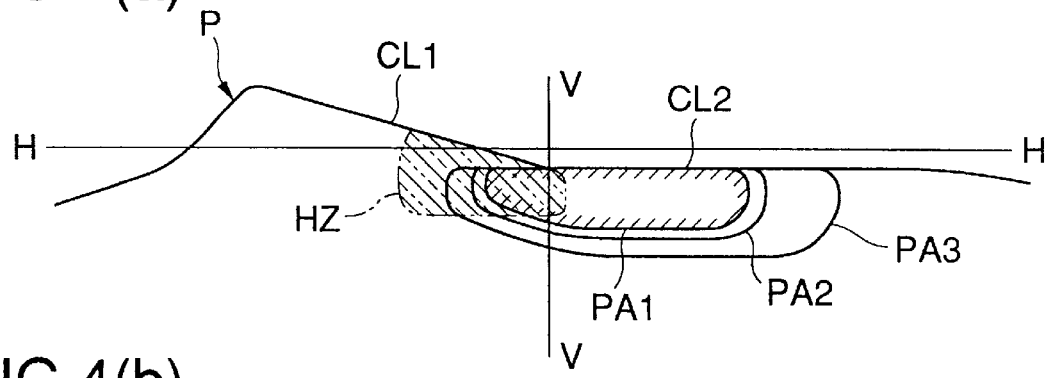
FIGS. 4(*a*)–(*c*) are diagrams for illustrating a principal parts of the invention, with FIG. 4(*c*) being a sectional view taken on line IV—IV of FIG. 1, and FIGS.(*a*) and (*b*) illustrating screen luminous intensity distribution patterns formed by the principal part.
Figure 4B:
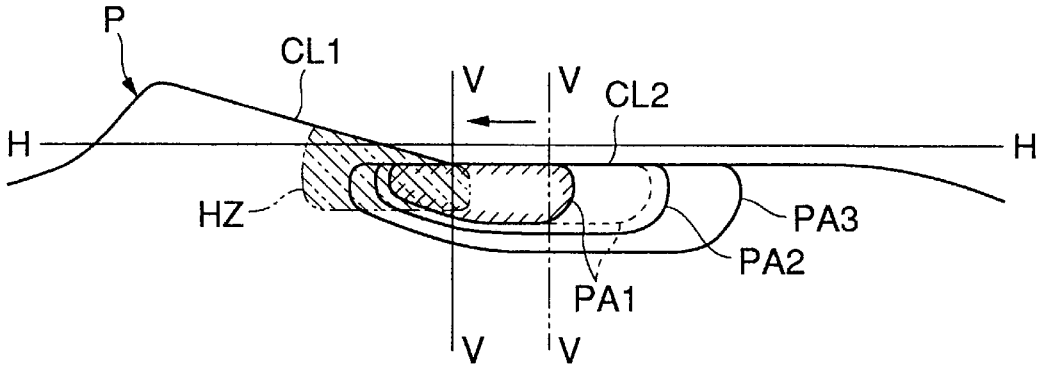
Figure 4C:
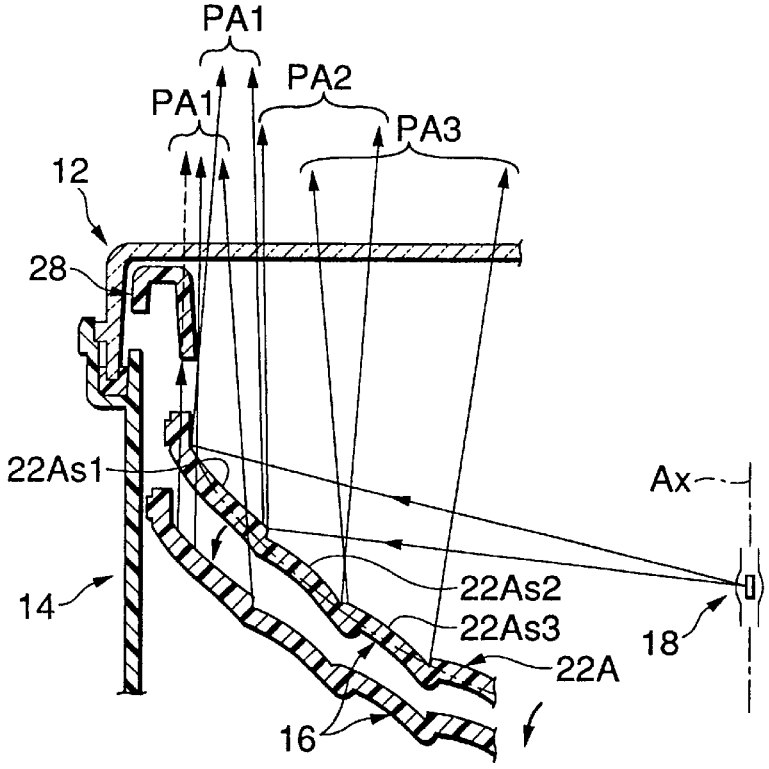

As shown in FIG. 4(*c*), which is a sectional view taken on line IV—IV of FIG. 1, a reflective surface element 22A*s*1 positioned in the outermost side portion out of the six reflective surface elements 22A*s* for forming the horizontal cut line has a concave horizontal-sectional shape, whereas the remaining reflective surface elements 22A*s*2, 22A*s*3 , . . . all have a convex horizontal sectional shape. Therefore, the light reflected from the reflective surface elements 22A*s*2, 22A*s*3 , . . . other than the reflective surface element 22A*s*1 is directed from the left-hand end portion to the left and also directed from the right-hand end portion to the right but the light reflected from the reflective surface element 22A*s*1 is directed from the left-hand end portion to the right and also directed from the right-hand end portion to the left, whereby as shown in FIG. 3, rays of reflected light horizontally cross each other to form a luminous intensity distribution pattern PA1.

The reflective surface element 22A*s*1 positioned in the outermost side portion and the reflective surface element 22A*s*2 adjacent to the inside of what is positioned in the outermost side portion above are, as shown in FIG. 4(*a*), set to have substantially the same diffusion angle of reflection. Further, the second reflective surface element 22A*s*2 is used to form a luminous intensity distribution pattern to be formed originally by a reflective surface element positioned in the outermost side portion and with respect to the luminous intensity distribution pattern formed by the reflective surface element 22A*s*1 in the outermost side portion, it is utilized additionally for the hot-zone reinforcing purpose.

Figure 5A:
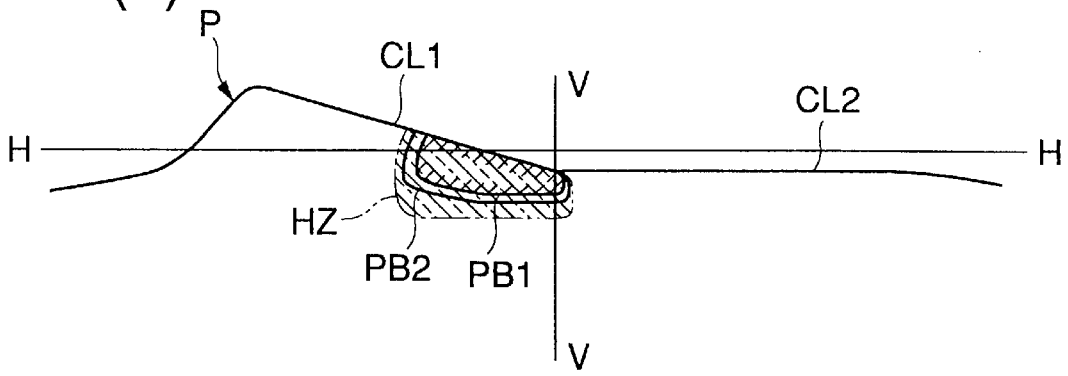
FIGS. 5(*a*)–5(*c*) are diagrams illustrating another principal part of the embodiment thereof with FIG. (*c*) being a sectional view taken on line V—V of FIG. 1, and FIGS. 5(*a*)
Figure 5B:
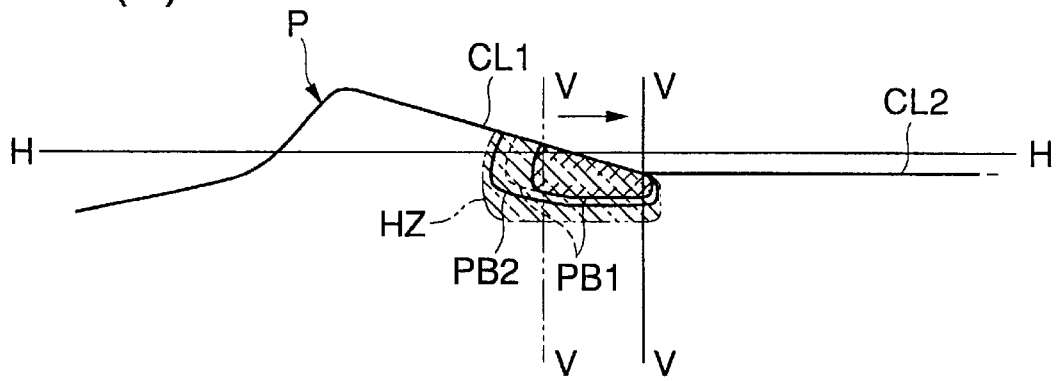
Figure 5C:
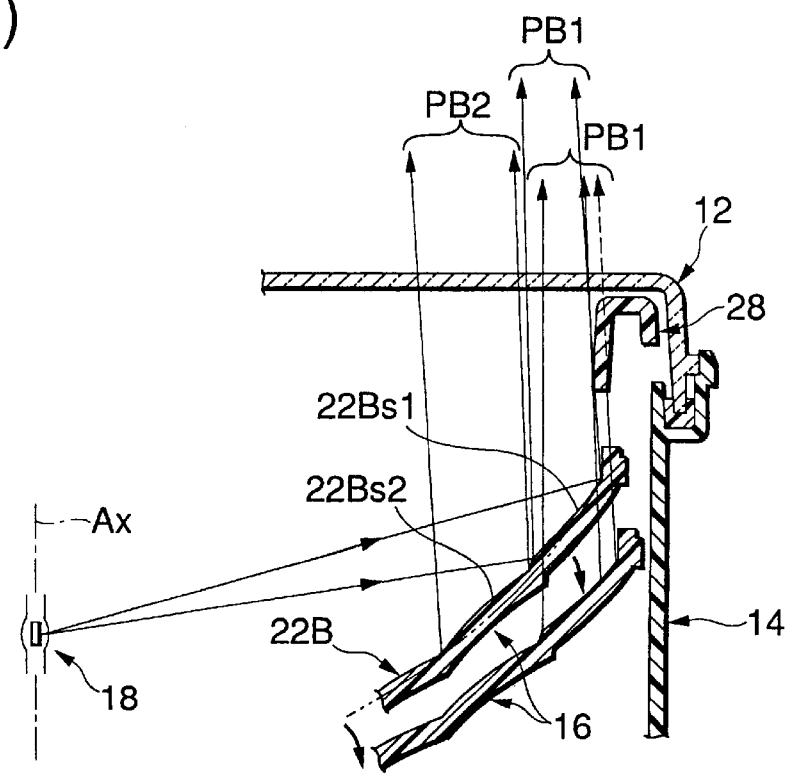

Similarly as shown in FIG. 5(*c*), which is a sectional view taken on line V—V of FIG. 1, a reflective surface element 22B*s*1 positioned in the outermost side portion in an oblique cut-line forming area 22B has a concave horizontal sectional shape, whereas those remaining, starting with a second reflective surface elements 22B*s*2, all have a convex horizontal sectional shape. The reflective surface element 22A*s*1 in the outermost side portion and the second reflective surface element 22B*s*2 are, as shown in FIG. 5(*a*), set to have substantially the same diffusion angle of reflection. Further, the second reflective surface element 22B*s*2 is used to form a luminous intensity distribution pattern (a hot-zone forming luminous intensity distribution pattern) to be formed originally by a reflective surface element positioned in the outermost side portion and with respect to the luminous intensity distribution pattern formed by the reflective surface element 22B*s*1 in the outermost side portion, it is utilized additionally for the hot-zone reinforcing purpose.

The function of the head lamp according to the present invention will subsequently be described.

Since rays of the light reflected from the reflective surface element 22A*s*1 horizontally cross each other as described above, the light reflected from the reflective surface element 22A*s*1 and also the light from its left-hand end portion are irradiated in the forward direction of the lighting fixture without being blocked by the extension 28 despite the presence of the extension 28 along the outer peripheral edge of the reflector 16 in front of the reflector 16 as shown in FIG. 4(*c*).

When the reflector 16 is aimed to the left, on the other hand, the light reflected from the left-hand end portion of the reflective surface element 22A*s*1 is blocked off by the extension 28 as shown in FIG. 4(*c*) and the luminous intensity distribution pattern PA1 formed by the light reflected from the other portion of the reflective surface element 22A*s*1 becomes a luminous intensity distribution pattern shown by a solid line with the wane of its right-hand end portion as shown in FIG. 4(*b*). Consequently, a state in which the luminous intensity distribution pattern PA1 is contributing to the formation of the hot-zone HZ of the sub-lamp luminous intensity distribution pattern P is maintained at the time of aiming and a dark portion is never formed as in the prior art. Therefore, there is no possibility of allowing the formation of the sub-lamp luminous intensity distribution pattern which makes it hard to visually recognize the remote forward field of the vehicle even at the time of aiming.

Thus, a desired sub-lamp luminous intensity distribution pattern is obtainable from the head lamp for the formation of the sub-lamp luminous intensity distribution pattern designed to control light from the discharge bulb by the plurality of reflective surface elements constituting the reflective surface of the reflector according to this embodiment of the invention even in such a state that the reflector has been subjected to aiming adjustment.

According to this embodiment of the invention, moreover, the reflective surface element 22A*s*1 positioned in the outermost side portion and the reflective surface element 22A*s*2 adjacent thereto inward are set to have substantially the same diffusion angle of reflection and, further, the second reflective surface element 22A*s*2 is used to form a luminous intensity distribution pattern to be formed originally by a reflective surface element positioned in the outermost side portion and with respect to the luminous intensity distribution pattern formed by the reflective surface element in the outermost side portion, it is utilized additionally for the hot-zone reinforcing purpose. With this arrangement of controlling the luminous intensity distribution, a stable sub-lamp luminous intensity distribution pattern becomes formable, irrespective of the aiming position.

According to this embodiment of the invention, moreover, the reflective surface element 22B*s*1 positioned in the outermost side portion of the oblique cut-line forming area 22B has a concave horizontal sectional shape, and rays of the light reflected from the reflective surface element 22B*s*1 horizontally cross each other as shown in FIG. 5(*c*), whereby the light reflected from the reflective surface element 22Bs1 and also the light from its right-hand end portion are irradiated in the forward direction of the lighting fixture without being blocked off by the extension 28 despite the provision of the extension 28 along the outer peripheral edge of the reflector 16 in front of the reflector 16 as shown in FIG. 5(*c*). When the reflector 16 is aimed to the right, though the light reflected from the right-hand end portion of the reflective surface element 22B*s*1 is shaded as shown in FIG. 5(*c*), a luminous intensity distribution pattern PB1 formed by the light reflected from the other portion of the reflective surface element 22B*s*1 becomes a luminous intensity distribution pattern shown by a solid line with a leftover portion close to the V—V axis to ensure that a sub-lamp luminous intensity distribution pattern for making it easy to visually recognize the remote forward field of the vehicle is secured even at the time of aiming as shown in FIG. 5(*b*).

We claim:

1. A vehicle head lamp comprising:

a discharge bulb; and a reflector having a reflective surface constituting of a plurality of reflective surface elements for reflecting light from the discharge bulb forwardly so as to form a sub-lamp luminous intensity distribution pattern having an oblique cut line and a horizontal cut line by controlling light reflected from each of the reflective surface elements, wherein a first of said reflective surface elements, positioned in the outermost side of said plurality of reflective surface elements constituting a horizontal cut-line forming area on the reflective surface, has a concave horizontal sectional shape and wherein a second of said reflective surface elements adjacent to the inside of said first reflective surface element has a convex horizontal sectional shape.

2. A vehicle head lamp as claimed in claim 1, wherein a third reflective surface element positioned in the outermost side portion of said plurality of reflective surface elements constituting a oblique cut-line forming area on the reflective surface has a concave horizontal sectional shape and wherein a fourth reflective surface element adjacent to the inside of said third reflective surface element in the outermost side portion has a convex horizontal sectional shape.

3. A vehicle head lamp as claimed in claim 1, wherein said first and second reflective surface elements are set to have substantially the same horizontal diffusion angle of reflection.

4. A vehicle head lamp as claimed in claim 2, wherein said third and fourth reflective surface elements are set to have substantially the same horizontal diffusion angle of reflection.

5. A vehicle head lamp as claimed in claim 1, wherein an extension is formed along the outer peripheral edge of the reflector in front of the reflector.

6. A vehicle head lamp as claimed in claim 2, wherein an extension is formed along the outer peripheral edge of the reflector in front of the reflector.

7. A reflector for a vehicle head lamp having a discharge bulb, comprising:

a reflective surface constituting of a plurality of reflective surface elements for reflecting light from the discharge bulb forwardly so as to form a sub-lamp luminous intensity distribution pattern having an oblique cut line and a horizontal cut line by controlling light reflected from each of the reflective surface elements, wherein a first of said reflective surface elements, positioned in the outermost side of said plurality of reflective surface elements constituting a horizontal cut-line forming area on the reflective surface, has a concave horizontal sectional shape and wherein a second of said reflective surface elements adjacent to the inside of said first reflective surface element has a convex horizontal sectional shape.

8. A reflector in claim 7, wherein a third reflective surface element positioned in the outermost side portion of said plurality of reflective surface elements constituting a oblique cut-line forming area on the reflective surface has a concave horizontal sectional shape and wherein a fourth reflective surface element adjacent to the inside of said third reflective surface element in the outermost side portion has a convex horizontal sectional shape.

9. A reflector as claimed in claim 7, wherein said first and second reflective surface elements are set to have substantially the same horizontal diffusion angle of reflection.

10. A reflector as claimed in claim 8, wherein said third and fourth reflective surface elements are set to have substantially the same horizontal diffusion angle of reflection.

11. A reflector as claimed in claim 7, wherein an extension is formed along the outer peripheral edge of the reflector in front of the reflector.

12. A reflector as claimed in claim 8, wherein an extension is formed along the outer peripheral edge of the reflector in front of the reflector.

13. A reflector as claimed in claim 9, wherein an extension is formed along the outer peripheral edge of the reflector in front of the reflector.

14. A vehicle head lamp as claimed in claim 3, wherein an extension is formed along the outer peripheral edge of the reflector in front of the reflector.

15. A vehicle head lamp comprising:

a discharge bulb; and a reflector having a reflective surface including a plurality of reflective surface elements for reflecting light from said discharge bulb forwardly so as to form a sub-lamp luminous intensity distribution pattern having an oblique cut-line and a horizontal cut-line by controlling light reflected from each of the reflective surface elements, wherein a first reflective surface element, positioned in an outermost side of said plurality of reflective surface elements constituting at least one of a horizontal cut-line forming area and a oblique cut-line forming area on said reflective surface, has a concave horizontal sectional shape and wherein a second reflective surface element adjacent to an inner side of said first reflective surface element has a convex horizontal sectional shape.

16. A vehicle head lamp as claimed in claim 15, wherein said first reflective surface element and said second reflective surface element are set to have substantially the same horizontal diffusion angle of reflection.

17. A vehicle head lamp as claimed in claim 15, wherein an extension is formed along an outer peripheral edge of said reflector in front of said reflector.

18. A reflector for a vehicle head lamp having a discharge bulb, comprising:

a reflective surface including a plurality of reflective surface elements for reflecting light from said discharge bulb forwardly to form a sub-lamp luminous intensity distribution pattern having an oblique cut-line and a horizontal cut-line by controlling light reflected from each of said reflective surface elements, wherein a first reflective surface element, disposed at an outermost side of said plurality of reflective surface elements constituting at least one of a horizontal cut-line forming area and a oblique cut-line forming area on said reflective surface, has a concave horizontal sectional shape, and wherein a second reflective surface element, adjacent to an inner side of said first reflective surface element has, a convex horizontal sectional shape.

19. A reflector as claimed in claim 18, wherein said first reflective surface element and said second reflective surface element are set to have substantially the same horizontal diffusion angle of reflection.

20. A reflector as claimed in claim 18, wherein an extension is formed along an outer peripheral edge of said reflector in front of said reflector.

* * * * *